US005992502A

United States Patent [19]

Blaimschein et al.

[11] Patent Number: 5,992,502

[45] Date of Patent: Nov. 30, 1999

[54] METHOD OF PRODUCING METALLIC BAR STOCK

[75] Inventors: Gottfried Blaimschein; Otto Hein, both of Steyr; Rupert Wieser, Seitenstetten, all of Austria

[73] Assignee: GFM Holding AG, Steyr, Austria

[21] Appl. No.: 08/797,178

[22] Filed: Feb. 10, 1997

[30] Foreign Application Priority Data

Feb. 20, 1996 [AU] Australia ..... 309

[51] Int. Cl.[6] ..... B22D 11/12; B21B 1/46

[52] U.S. Cl. ..... 164/476; 164/417; 29/527.7; 29/33 C; 72/376; 72/377

[58] Field of Search ..... 164/476, 417; 29/527.7, 33 C; 72/376, 377

[56] References Cited

U.S. PATENT DOCUMENTS

| | | | |
|---|---|---|---|
| 3,857,741 | 12/1974 | Hultgren et al. | 148/648 |
| 4,462,844 | 7/1984 | Takahashi et al. | 148/610 |
| 4,930,207 | 6/1990 | Kojima et al. . | |
| 5,055,257 | 10/1991 | Chakrabarti et al. | 148/564 |
| 5,282,374 | 2/1994 | Kojima et al. | 164/476 |
| 5,342,459 | 8/1994 | Klemp et al. | 148/690 |
| 5,377,744 | 1/1995 | Maddock | 164/476 |
| 5,671,631 | 9/1997 | Serizawa et al. | 72/256 |

FOREIGN PATENT DOCUMENTS

| | | | |
|---|---|---|---|
| 62-207526 | 9/1987 | Japan | 72/377 |
| 1259152 | 10/1989 | Japan | 29/33 C |

*Primary Examiner*—Patrick Ryan
*Assistant Examiner*—I-H. Lin
*Attorney, Agent, or Firm*—Collard & Roe, P.C.

[57] ABSTRACT

For producing metallic bar stock there is first of all fabricated a primary product of substantially regularly round or angular cross-section, and this primary product is then deformed in cross-section to the final dimension corresponding to the bar stock by means of shaping. To provide for an efficient production of high-quality bar stock also in a minor quantity, the completely solidified primary product is subjected to a forging operation for a structural improvement before shaping it to the final dimension, during which forging off in one processing plane a spreading-restricted reduction of the cross-section in the range from (1.5 to 5):1 is effected.

8 Claims, 1 Drawing Sheet

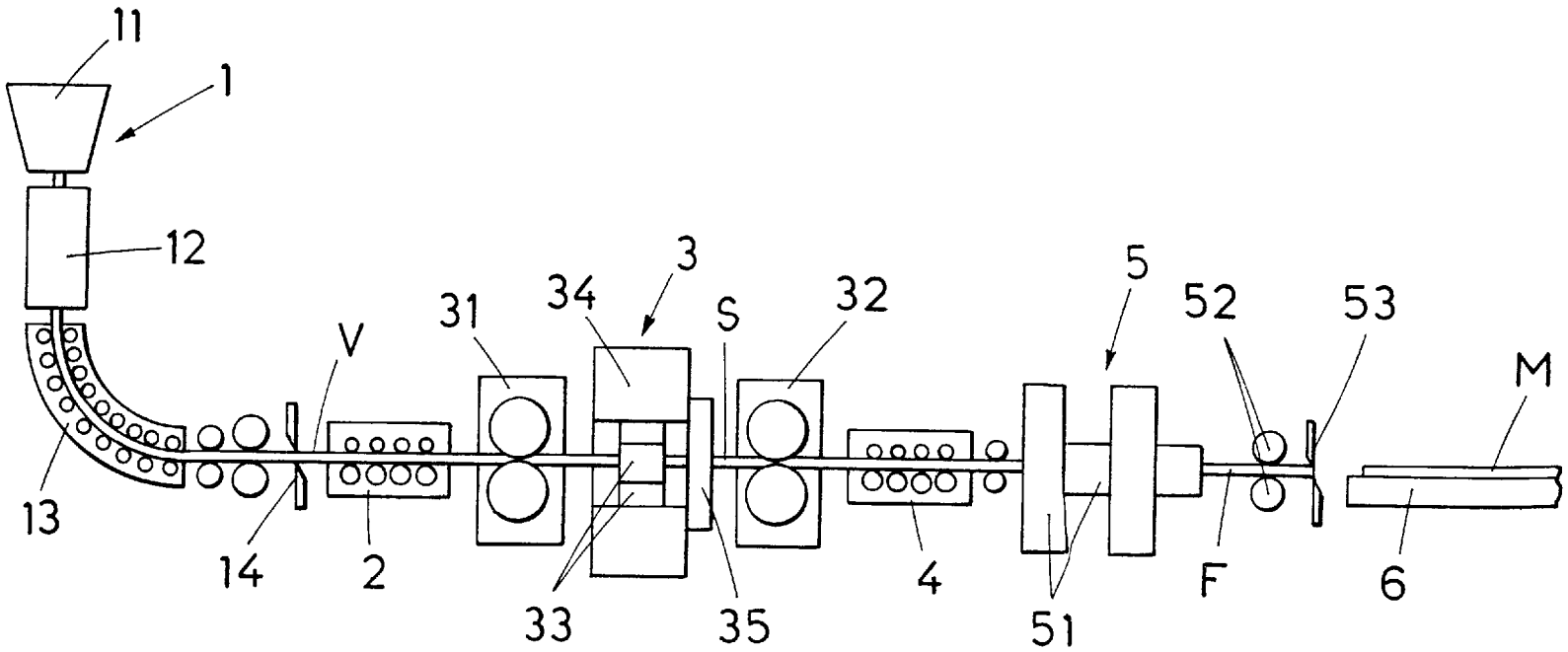
M
6
53
52
F
5
51
4
32
S
35
3
34
33
31
2
V
14
1
12
11
13

METHOD OF PRODUCING METALLIC BAR STOCK

BACKGROUND OF THE INVENTION

1. Field of the Invention

This invention relates to a method of producing metallic bar stock, where a primary product of substantially regularly round or angular cross-section is first of all fabricated by continuous casting and subjected to a forging operation, and this primary product is then deformed in cross-section to the final dimension corresponding to the bar stock by means of shaping.

2. Description of the Prior Art

For producing bar steel it is already known to prefabricate a primary product by continuous casting, and in a subsequent rolling process shape it into the finished product with a desired final dimension, where it is necessary, however, to achieve a reduction of the cross-section of about 8:1, so as to convert the coarse-grained cast structure of the primary product into a fine-grained structure providing the required mechanical properties of the bar steel. Since on each rolling stand, i.e. with each forming step, rolling can only lead to a reduction of the cross-section of about 1.2:1, a plurality of passes or rolling stands is required, until the desired reduction of the cross-section of about 8:1 has been achieved. This high rolling expenditure is unjustified for high-quality material, which is only required in small amounts, and in addition the large reduction requires large casting cross-sections, which in turn increase the expenditure for the continuous casting plant.

In accordance with U.S. Pat. No. 4,930,207 A it has already been proposed to subject the primary product to a forging operation, to prevent the formation of segregations and shrink holes in the interior of the strand material due to the solidification, for which purpose forging is effected during the transition of the core portion from the liquid phase into the solid phase and is performed with a forging frequency adapted to the casting speed and with tools adapted to the width of the liquid core portion. This type of forging specially applied for preventing segregations and shrink holes does, however, not lead to a change in the actual material structure, i.e. the crystalline structure of the strand material, so that here as well the primary product has a cast structure after forging.

SUMMARY OF THE INVENTION

It is therefore the object underlying the invention to provide a method as described above, which allows for an economic application of continuous casting even in the production of small amounts of high-quality bar stock.

This object is solved by the invention in that only after having completely solidified, the continuously cast primary product is forged off to achieve a structural improvement, where in at least one processing plane a spreading-restricted reduction of the cross-section in the range from (1.5 to 5):1 is effected. As extensive experiments have demonstrated, a forging operation, which covers the entire periphery of the primary product in the processing plane and thus substantially restricts or even prevents a spreading, in connection with a reduction of the cross-section of 1.5:1 and more, can already lead to a thorough structural improvement, which leads to a fine-grained structure extending over the entire cross-section and provides the desired quality of the material. During forging it is, however, not necessary to apply an impact effect on all sides, there might very well only be effected a working acting on opposite points, when the remaining peripheral portions have been supported against a yielding of the material by means of corresponding material guides or the like, so that spreading is restricted. Preferably, three or more tools are simultaneously used in one plane, but it would also be possible to forge by means of two tools correspondingly engaging over the primary product along the periphery, where forging can in addition be effected by means of any suitable forging machine or forging press. The structural improvement achieved not only ensures the desired product quality, but also provides for the subsequent easy shaping of the primary product to the final dimension of the finished product, without having to particularly consider the deformation mode or the amount of deformation. In addition, the weak reduction of the cross-section of 1.5:1, which is already sufficient for a structural improvement, provides for a continuous casting with cross-sections much closer to the final dimensions of the finished product, which in the case of small amounts of bar stock already ensures a very economic production. The structural improvement of the primary product is of course not only achieved in steel, but in all other forgeable metals, so that in particular bar stock made of copper or copper alloys, aluminum or aluminum alloys and the like can efficiently be produced.

When the primary product is subjected to a heat treatment before and/or after the forging operation, the primary product can be brought to the proper forging temperature depending on the material properties by holding or subsequently heating or even by reheating the continuously cast material, and the best forging conditions can be ensured. The heat treatment itself can be performed in all kinds of heating means and furnaces, in a continuous process such as in a buffer process or also directly in the feed zone of the forging machine and the like, and depends on the respective material properties and process sequences, subsequent to the forging operation there is possibly required a cooling of the material, in order to avoid a recrystallization of the structure, in particular when copper or other non-ferrous metals are being processed.

At suitable casting speeds the primary product can of course be supplied in one pass from the continuous casting to the forging operation, where forging is effected by means of a forging machine, which for feeding the strand has chucks or driving rollers or the like forming a corresponding workpiece duct.

The primary product can, however, also be cut to length from the cast and solidified strand and be forged off piece by piece and be subjected to a further deformation, which involves larger freedom as regards the forging operation and also opens up the possibility of temporarily storing the primary products cut to length.

For efficiently producing pipe material, a tubular primary product is fabricated in accordance with an advantageous aspect of the invention and is then forged off over a mandrel, so that the same advantages of the forging operation can also fully be utilized in the pipe production. The continuous casting of a tubular primary product is usually performed by means of a mandrel in the used casting mold, and it is then expedient for forging off in one pass with the continuous casting, when the forging mandrel is connected to the casting mandrel via a mandrel bar, so as to ensure the continuous strand casting and forging operation.

In the case of primary products cut to length the tubular primary product can of course be forged off over a mandrel in the known manner, where it is also possible to provide the mandrel with a mandrel bar of corresponding length and, when using a hollow manipulator, to axially slide the primary product onto the mandrel bar and the mandrel.

In the case of hardly deformable metals it is favorable to forge off the primary product under an axial and rotary feed, where such rotary forging can easily be performed with primary products cut to length. In the case of continuous forging, however, the tool-carrying inner portion of the forging box or the like must rotate or the strand must be rotated in a casting device with rotating mold, depending on whether the tool or the workpiece rotates.

When forging is performed in one pass with the continuous casting, the deformation to the final dimension can immediately be effected also during this pass, so that the material is cast, forged and shaped in one continuous operation, which provides for a particularly efficient production of certain materials and products. Usually, the operation is interrupted either between continuous casting and forging or between forging and shaping, so as to provide a corresponding heat treatment or be able to maintain and use certain working speeds and working methods.

Since the primary product has an excellent structure after the forging operation, virtually any technology may be used for shaping, and shaping may for instance be effected by rolling or by drawing or also by a continued forging operation. Depending on the material and the final tolerances, the one or the other method or even a combination of various shaping methods will be selected for shaping.

BRIEF DESCRIPTION OF THE DRAWING

The method in accordance with the invention is illustrated in detail in the drawing by way of example by means of a schematic representation of the plant.

DESCRIPTION OF THE PREFERRED EMBODIMENT

For the efficient production of metallic bar stock M, a primary product V of regularly round or angular cross-section is prefabricated in a continuous casting plant 1, which usually consists of a casting device 11, a mold 12 and, in the case of vertical casting, a deflection means 13, to which a separating means 14 is associated on the outlet side, which cuts to length the resulting strand constituting a primary product. The primary product V is then delivered to a furnace 2, in which it is temporarily stored for homogenization or is subjected to a heat treatment for heating it to the forging temperature or the like, and then reaches a forging means 3. The same is equipped with forging manipulators or driving rollers 31, 32 for feeding the workpiece and has a forging box 34 preferably accommodating four forging tools 33, in which forging box the primary product V is forged off without spreading in one forging plane. This forging operation leads to a reduction of the cross-section in the range from 1.5 to 5:1, which improves the coarse-grained cast structure of the primary product resulting from continuous casting to a fine-grained structure of the forged product S. The forged primary product S is possibly cooled in a cooling means 35 and via a further heating means 4 is then possibly supplied to a temporary storage and heat treatment in a shaping plant, which for instance consists of the rolling train 5 with a plurality of rolling stands 51 arranged one behind the other, in which rolling train the forged product S is shaped into a finished product F with the desired final dimension. Through delivery rollers 52 and a cross-cut station 53 the finished product is delivered as bar stock M cut to length to a deposition point 6, from where it can possibly be passed on to the further processing.

We claim:

1. A method of producing a metallic bar stock, which comprises the consecutive steps of:

(a) continuously casting a primary product of substantially regular round or polygonal cross section, (b) permitting the primary product to solidify completely, (c) forging the completely solidified primary product for a structural improvement thereof, (1) the forging in at least one forging plane imparting to the cross section a reduction in the range of (1.5 to 5):1 while circumferentially restricting spreading of the cross section, and (d) shaping the cross section to impart to the bar stock a desired final dimension.

2. The method of claim 1, comprising the further step of subjecting the primary product to a heat treatment before forging the primary product.

3. The method of claim 1, comprising the further step of subjecting the primary product to a heat treatment after forging the primary product.

4. The method of claim 1, wherein casting and forging are effected in one pass.

5. The method of claim 1, further comprising the step of cutting the cast primary product into lengths, and each length of the primary product is forged and shaped.

6. The method of claim 1, wherein the primary product is tubular.

7. The method of claim 1, wherein the forging and shaping are effected in one pass.

8. The method of claim 1, wherein shaping is effected by rolling.

* * * * *

UNITED STATES PATENT AND TRADEMARK OFFICE

CERTIFICATE OF CORRECTION

PATENT NO. : 5,992,502
DATED : November 30, 1999
INVENTOR(S) : BLAIMSCHEIN ET AL It is certified that error appears in the above-indentified patent and that said Letters Patent is hereby corrected as shown below:

On the title page, column 1, line 2 of Item [30], please change

"Australia" to --Austria--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*